US007582046B2

(12) United States Patent
Kayhan et al.

(10) Patent No.: US 7,582,046 B2
(45) Date of Patent: Sep. 1, 2009

(54) ROLL AS WELL AS A SPACER RING THEREFOR

(75) Inventors: Menderes Kayhan, Tumba (SE); Jimmy Ankargren, Årsta (SE)

(73) Assignee: Sandvik Intellectual Property AB, Sandviken (SE)

( * ) Notice: Subject to any disclaimer, the term of this patent is extended or adjusted under 35 U.S.C. 154(b) by 468 days.

(21) Appl. No.: 11/447,308

(22) Filed: Jun. 6, 2006

(65) Prior Publication Data

US 2006/0287178 A1 Dec. 21, 2006

(30) Foreign Application Priority Data

Jun. 17, 2005 (SE) ..... 0501386

(51) Int. Cl.
*F16C 13/00* (2006.01)

(52) U.S. Cl. ..... 492/39; 492/38; 492/40; 492/1

(58) Field of Classification Search ..... 492/38, 492/39, 40, 45, 1
See application file for complete search history.

(56) References Cited

U.S. PATENT DOCUMENTS

| | | | | | |
|---|---|---|---|---|---|
| 1,671,522 | A | * | 5/1928 | Furbush | 492/40 |
| 2,186,890 | A | * | 1/1940 | Wilkie | 492/40 |
| 2,226,777 | A | * | 12/1940 | Martin | 403/217 |
| 2,445,271 | A | * | 7/1948 | Huebner | 361/214 |
| 3,667,096 | A | | 6/1972 | Edsmar | |
| 3,803,683 | A | * | 4/1974 | Oxlade | 492/1 |
| 3,842,471 | A | * | 10/1974 | Polhall et al. | 492/1 |
| 3,851,365 | A | * | 12/1974 | Oxlade | 492/1 |
| 4,208,147 | A | * | 6/1980 | Giege et al. | 492/21 |
| 4,378,686 | A | * | 4/1983 | Pardoe | 72/262 |
| 4,841,612 | A | | 6/1989 | Kark | |
| 4,932,111 | A | | 6/1990 | Kark | |
| 5,406,706 | A | | 4/1995 | Nagai | |
| 5,483,812 | A | | 1/1996 | Dempsey | |
| 5,735,788 | A | | 4/1998 | Yasutake et al. | |
| 6,685,611 | B1 | | 2/2004 | Kark | |
| 2006/0287175 | A1 | * | 12/2006 | Vlk et al. | 492/39 |
| 2006/0287176 | A1 | * | 12/2006 | Gleizer et al. | 492/47 |

FOREIGN PATENT DOCUMENTS

| | | |
|---|---|---|
| DE | 6753723 | 7/1969 |
| DE | 2528157 C2 | 7/1976 |
| EP | 0 099 073 | 1/1984 |
| EP | 0343440 B1 | 11/1989 |
| EP | 0 488 022 | 6/1992 |
| JP | 59-001009 | 1/1984 |

* cited by examiner

*Primary Examiner*—Essama Omgba
(74) *Attorney, Agent, or Firm*—Drinker Biddle & Reath LLP

(57) ABSTRACT

A combi roll that comprises a roll shaft having a rotationally symmetrical basic shape defined by a central axis, as well as a number of rings in the form of roll rings and spacer rings, each one of which has planar end surfaces that extend between outer and inner, circular limiting edgelines, and that serve as contact surfaces against adjacent rings. At least one of the end surfaces of a ring, preferably a spacer ring, is limited by an inner edgeline, the diameter of which is greater than the outer diameter of the roll shaft. In such a way, the area of the contact surface is reduced while increasing the surface pressure, at the same time as the force transmitting ability of the surface increases by the fact that the radial distance to the center axis is increased.

4 Claims, 1 Drawing Sheet

ROLL AS WELL AS A SPACER RING THEREFOR

FIELD OF THE INVENTION

The present invention relates to a combi roll that comprises a roll shaft having a rotationally symmetrical basic shape that is defined by a central axis, as well as a number of rings mounted on the roll shaft, each one of which has two planar end surfaces extending between outer and inner, circular limiting edges, and serving as friction contact surfaces for the transmission of torque to adjacent rings.

BACKGROUND

Frequently, combi rolls include two or more roll rings, which are kept separated by intermediate spacer rings, the entire set of rings being kept fixed on the shaft by way of, on one hand, a fixed stop ring, e.g., a shoulder of the roll shaft, and, on the other hand, a lock nut that via an internal thread may be tightened on a male thread of the shaft. Furthermore, between the lock nut and the set of roll rings, spring devices as well as additional spacer rings may be present.

In many cases, the roll rings are manufactured from cemented carbide, while the intermediate spacer rings are manufactured from a softer or more ductile material, preferably steel or cast iron. Considerable torque should be transmitted to the roll rings from the roll shaft. When the roll rings are made of solely cemented carbide, this usually takes place by an axial (cylindrical) train of forces from the lock nut to the fixed stop ring via the contact surfaces between the individual rings. More precisely, the torque is transmitted from the individual ring to an adjacent ring by a friction action in the interfaces, where an end surface of a ring is pressed against a co-operating end surface of the adjacent ring. In order to fulfil this task throughout the train of forces, the individual friction joints between the rings have to be powerful, i.e., be able to transfer torque without the rings slipping in relation to each other.

In previously known combi rolls (see, for instance, U.S. Pat. No. 5,735,788 and U.S. Pat. No. 6,685,611) the roll rings as well as the spacer rings are formed with end surfaces extending radially all the way from the inside to the outside, i.e., from the envelope surface of the roll shaft to the external cylinder surface of the individual ring. However, this fact has turned out to be detrimental for the ability of the friction joints to transmit a large torque between the rings. Thus, the described design results in the transmission of force in a zone situated about halfway between the inside and the outside of the spacer ring, i.e., as close to the envelope surface and the center axis of the roll shaft, respectively, as possible. Furthermore, the surface pressure in the interfaces between the contact surfaces becomes relatively low because the contact surfaces are comparatively large. For these reasons, it may happen that the rings slip in relation to each other, something which in turn may lead to production interruptions and in the worst case, roll breakdowns.

SUMMARY

The present invention aims at obviating the above-mentioned shortcomings of previously known combi rolls and at providing an improved roll. Therefore, a primary object of the invention is to provide a combi roll in which large torques may be transferred between adjacent rings via friction joints, which in a reliable way counteract slipping between the rings. In other words, the invention aims at providing powerful and efficient friction joints between the rings in the roll. It is also an object to provide the improved friction joints by simple elements and in a manner that even can be material-saving.

According to a first aspect, a roll comprises a roll shaft having a rotationally symmetrical basic shape that is defined by a center axis. A plurality of rings are mounted on the roll shaft, each one of the rings having two planar end surfaces extending between outer and inner, circular limiting edges, and serving as friction contact surfaces for the transmission of torque to adjacent rings. At least one of the end surfaces of one of the rings is limited by an inner edge, a diameter of the one of the rings being greater than an outer diameter of the roll shaft.

According to a second aspect, a spacer ring for rolls comprises external and internal, rotationally symmetrical limiting surfaces and two planar end surfaces axially spaced-apart and facing away from each other, that extend between outer and inner, circular limiting edgelines, and serve as force transmitting friction contact surfaces against other rings included in a roll. The individual, force transmitting end surface is limited by an inner edgeline, a diameter of the end surface being greater than an inner diameter of the ring, such as this is determined by the internal limiting surface.

DETAILED DESCRIPTION

Figure 1:
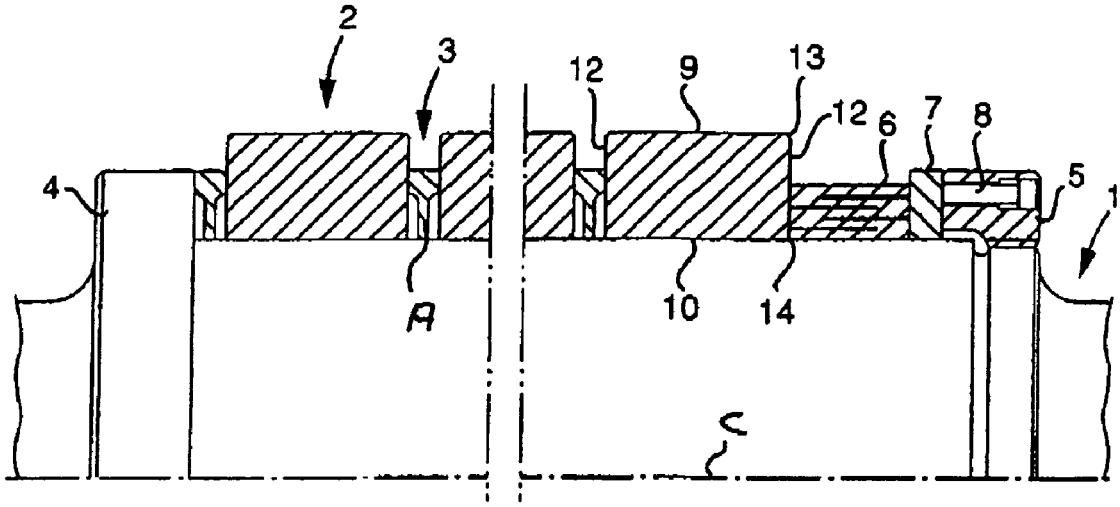
FIG. 1 is a partly cut longitudinal view through a combi roll according to the invention.

In FIG. 1, a roll is shown, which includes a drivable roll shaft 1, three roll rings 2, and three spacer rings 3. The roll shaft 1 has a rotationally symmetrical basic shape that is defined by a central axis C.

The set of rings 2, 3 is kept in place between a fixed stop ring 4, which in the example is in the form of a ring-shaped shoulder, and a lock nut 5 at the opposite end of the shaft. The lock nut has an internal thread (not visible), which may be tightened on an external thread of the roll shaft. Between the lock nut 5 and the first roll ring 2, there is, in this case, also a dynamic spring 6, which is separated from the lock nut 5 via a tightening ring 7. Furthermore, in the lock nut, there is a number of peripherally spaced-apart adjusting devices 8 by way of which the spring force in the spring 6 can be adjusted.

In the example, the roll rings 2 are assumed to be composed of solid cemented carbide, while the spacer rings 3 are made from a more ductile or softer metal, e.g., steel. Each individual roll ring 2 is delimited by external and internal cylinder surfaces 9, 10 as well as opposite end surfaces 12, each one of which is planar and extends perpendicularly to the center axis C. Each end surface 12 is limited outwardly by a circular limiting edge line 13 and inwardly by an inner, likewise circular edge line 14.

In an analogous way, the individual spacer ring 3 (see FIG. 3) is delimited by an external cylinder surface 11, which defines the outer diameter of the spacer ring, an internal cylinder surface 10, which defines the inner diameter of the spacer ring, as well as two opposite planar end surfaces 15, which extend perpendicularly to the center axis C.

In previously known spacer rings, the planar end surfaces 15 have extended radially all the way from the internal cylinder surface 10 to the external cylinder surface 11. In other words, the spacer rings have had the same general design as the tightening ring 7 shown to the right in FIG. 1.

Figure 4:
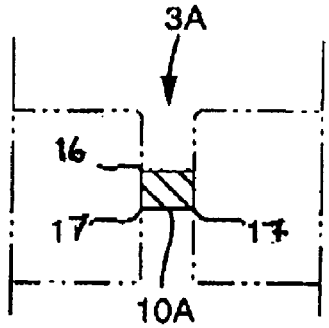
FIG. 4 is a cross section schematically illustrating an alternative embodiment of the invention.

According to an aspect of the present invention, the individual end surface 15 of the spacer ring 3 has been shaped in such a way that the inner limiting edge line 17 of the surface is greater than the outer diameter of the roll shaft, which in the example according to FIG. 4 corresponds to the inner diameter of the ring. (Outwardly the end surface 15 is limited by the circular edge line 16). In such a way, the total area of the end surface 15 for a given outer diameter is reduced, whereby the surface pressure against an adjacent roll ring is increased. Furthermore, the force transmission zone (i.e., an imaginary circular line halfway between the limiting edge lines 16 and 17) of the surface is moved out in comparison the corresponding force transmission zones in previously known spacer rings. In other words, the efficient torque arm is increased, such as this is determined by the radial distance between the center axis C and the force transmission zone.

Figure 2:
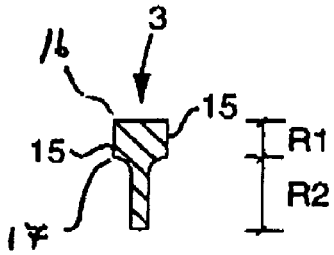
FIG. 2 is an enlarged cross section of a spacer ring included in the roll of FIG. 1.
Figure 3:
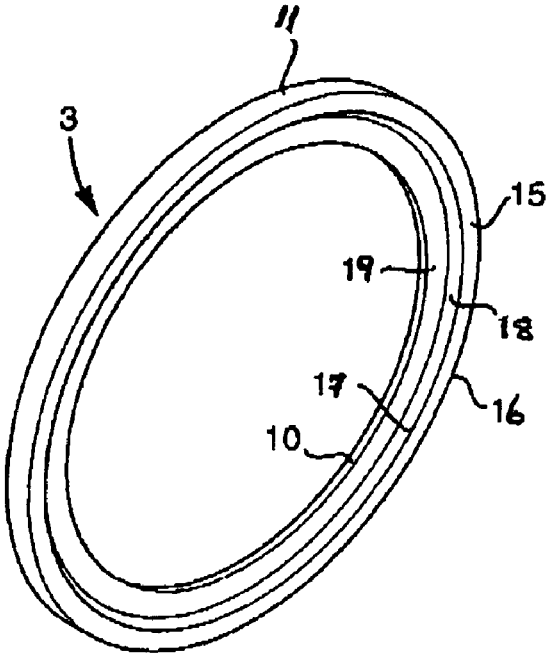
FIG. 3 is a perspective view of the spacer ring.

In the example shown in FIGS. 1, 2 and 3, the desired reduction of the area of the end contact surface 15 has been provided by the fact that the ring has been formed with, on one hand, an outer rim part 18, which has a thickness measured as the distance between the opposite end surfaces 15 that is greater than the thickness of an inner rim part 19, in which the hole of the ring delimited by the cylinder surface 10 is formed. By way of the inner rim part 19, the ability of the spacer ring to be centered is retained, when it is put on to the roll shaft 1. As is seen in FIG. 3, the outer rim part 18 has a radial extension (the radial distance R1 between the limiting edge lines 16, 17) which is smaller than the radial extension of the inner rim part 18, such as this is represented by the radial distance R2 between the limiting line 17 and the hole edge surface 10. In practice, R1 may amount to 50-80%, suitably 60-70% of R2, i.e. R2 may be 25 to 100%, or 42 to 66% greater than R1.

In FIG. 4, an alternative embodiment of a roll is shown in which the spacer ring 3A lacks the centering inner rim part according to the embodiment described above. Thus, in this case, a rotationally symmetrical hole edge surface 10A extends axially between the opposite inner edge lines 17 of the end surfaces 15. Centering of this spacer ring may either be effected by way of externally applied centering devices, or by way of an inner, ring-shaped core of another material, e.g., cellular plastic, wood or the like, which may be destroyed after mounting.

A layer of a large number of uniformly distributed grains may be applied to the interfaces between the end surfaces of the roll rings 2 and of the spacer rings 3, which grains are made from a material that is harder than the hardest material in anyone of the rings. If the roll rings are manufactured of cemented carbide, grains of, for instance, diamond, cubic boron nitride, ceramics or the like, may be used. The grains should have a size that is at least somewhat greater than the microscopic irregularities that decides the surface finish of the contact surfaces. When the roll rings and the spacer rings are urged towards each other by full force, the grains will then penetrate into the respective end surface and to a large extent increase the friction between the surfaces. Such grains do not make the separation of the rings from each other materially more difficult. In practice, the grains may be included in a paste or another viscous fluid, which may be provided onto the comparatively narrow, ring-shaped end contact surfaces of the spacer rings. Alternatively, the grains may be applied by plating technique.

The invention is not limited merely to the embodiments described above and shown in the drawings. Thus, it is feasible to form the radially reduced end contact surface on a roll ring, instead of on a spacer ring, although the exemplified embodiment is preferred in practice.

The presently disclosed embodiments are considered in all respects to be illustrative and not restrictive. The scope is indicated by the appended claims, rather than the foregoing description, and all changes that come within the meaning and range of equivalents thereof are intended to be embraced.

The invention claimed is:

1. A roll, comprising a roll shaft having a rotationally symmetrical basic shape that is defined by a center axis;

a plurality of rings mounted on the roll shaft, each one of said rings having two planar end surfaces extending between outer and inner, circular limiting edges, and serving as friction contact surfaces for the transmission of torque to adjacent rings;

wherein two opposite end surfaces of the rings are both limited by inner edges, diameters of which are greater than an outer diameter of the roll shaft;

said opposite end surfaces included in a spacer ring, one of said opposite end surfaces being urged against an end surface of a roll ring, the roll ring having an inner diameter equal to the outer diameter of the roll shaft.

2. The roll according to claim 1, wherein the spacer ring includes an outer rim part having an axial thickness measured as the distance between the opposite end surfaces that is greater than a thickness of an inner rim part, which has an internal, rotationally symmetrical hole edge surface, the diameter of which corresponds to the diameter of the roll shaft.

3. The roll according to claim 2, wherein the radial distance between the outer and inner limiting edges of an individual opposite end surface is smaller than the radial distance between one of the inner limiting edges and the hole edge surface.

4. The roll according to claim 1, wherein axially between the inner limiting edges of the two opposite end surfaces, a rotationally symmetrical surface extends, which forms an internal hole edge surface and has a diameter equal to a diameter of the limiting edges.

* * * * *